US005421693A

United States Patent [19]

Petersen

[11] Patent Number: 5,421,693

[45] Date of Patent: Jun. 6, 1995

[54] WHEELCHAIR TILTING APPARATUS

[76] Inventor: Philip L. Petersen, 411 N. Fern Dell Pl., Glendora, Calif. 91741

[21] Appl. No.: 177,560

[22] Filed: Jan. 5, 1994

[51] Int. Cl.[6] ..... A61G 7/10

[52] U.S. Cl. ..... 414/678; 414/921; 410/30

[58] Field of Search ..... 414/678, 921; 410/6, 410/30

[56] References Cited

U.S. PATENT DOCUMENTS

| | | | |
|---|---|---|---|
| 3,256,040 | 6/1966 | Mize et al. . | |
| 4,124,130 | 11/1978 | Rohrs et al. | 414/921 |
| 4,192,549 | 3/1980 | Petersen | 414/678 |
| 4,442,921 | 4/1984 | Sherman | 414/921 |
| 4,527,944 | 7/1985 | Qually et al. . | |
| 4,561,823 | 12/1985 | Norton | 414/678 |
| 4,725,188 | 2/1988 | Zimmermann et al. . | |
| 4,726,730 | 2/1988 | McConnell . | |
| 4,790,716 | 12/1988 | McConnell | 414/678 |
| 4,834,411 | 5/1989 | Willey et al. . | |
| 5,228,538 | 7/1993 | Tremblay | 414/921 |

FOREIGN PATENT DOCUMENTS

| | | | |
|---|---|---|---|
| 186541 | 11/1982 | Japan | 414/921 |

*Primary Examiner*—Michael S. Huppert
*Assistant Examiner*—Thomas J. Brahan

[57] ABSTRACT

A new and improved wheelchair tilting apparatus includes a base assembly and a wheelchair receiving assembly supported by the base assembly. The wheelchair receiving assembly includes a first platform portion and a first frame assembly supporting the first platform portion. The wheelchair receiving assembly also includes a second platform portion and a second frame assembly supporting the second platform portion. The first and second frame assemblies are connected to each other and oriented with respect to each other at a predetermined obtuse angle, such that the first and second platform portions are oriented with respect to each other at the predetermined obtuse angle. A tilt assembly is supported by the base assembly and is provided for tilting the wheelchair receiving assembly after a wheelchair is received in the wheelchair receiving assembly. The tilt assembly includes an electric motor and a gear assembly that is connected to the wheelchair receiving assembly, such that the tilt assembly controls a tilt angle of the wheelchair receiving assembly and the wheelchair supported thereon. Wheel assemblies are connected to bottom portions of the base assembly. A wheel-stop assembly is connected to the first platform portion for preventing rolling of the wheelchair when the wheelchair is resting on the first platform portion. A wheelchair backstop assembly is connected between respective first and second side frame assemblies that are connected respectively to the first and second frame assemblies. A headrest assembly is also connected between the first and second side frame assemblies.

6 Claims, 2 Drawing Sheets

WHEELCHAIR TILTING APPARATUS

BACKGROUND OF THE INVENTION

1. Field of the Invention

The present invention relates generally to devices for supporting wheelchairs and, more particularly, to devices for supporting wheelchairs when they are tilted backward.

2. Description of the Prior Art

Wheelchairs serve an important function and are used by many people. Aside from the many benefits that wheelchairs provide, there are a number of undesirable aspects of wheelchair use. For a person who spends a great deal of time in a wheelchair, the person may experience back fatigue and circulation problems. One remedy to the back problems and circulation problems is getting out of the wheelchair and lying down on a bed or sofa. However, getting out of the wheelchair may neither be desirable or possible for a number of reasons. In this respect, it would be desirable if a wheelchair device were provided which alleviated back fatigue and circulation problems without having the person get out of the wheelchair.

One solution to the problem of back fatigue and circulation problems associated with a wheelchair is to provide for tilting the wheelchair backwards as the person is seated in the wheelchair. Throughout the years, a number of innovations have been developed relating to the tilting of wheelchairs, and the following U.S. patents are representative of some of those innovations: U.S. Pat. Nos. 3,255,040; 4,527,944; 4,725,188; 4,725,730; and 4,834,411.

More specifically, U.S. Pat. No. 3,256,040 discloses a reclining attachment for wheelchairs which includes an hand-operated tilt mechanism that is suitable for tilting the wheelchair for moving the wheelchair over curbs. Many persons may not have the physical strength to operate such a hand-operated tilt mechanism. In this respect, it would be desirable if a wheelchair device were provided which included an electrically operated tilt mechanism.

U.S. Pat. No. 4,527,944 discloses another wheelchair tilting device which is hand-operated. A complicated array of linkage bars convert a rotational hand-operated crank into a tilting of the wheelchair. The complex array of linkage bars is subject to significant wear and tear. In this respect, it would be desirable if a wheelchair device were provided which employed a tilting mechanism that does not require a complex array of linkage bars.

U.S. Pat. No. 4,725,188 discloses an article of furniture that receives a wheelchair and permits the wheelchair to be tilted backwards. The furniture includes track rail members that have upwardly opening concave tracks which extend rearwardly from a lowermost point to a first slightly raised position and then extend along curved paths in an are having about the same or slightly larger radius of curvature as the large wheels of the wheel chair to be accommodated. The tilting of the wheelchair can be powered by a battery-powered electric motor. In the tilted position, the person's head is resting upon headrest. A number of disadvantages are associated with this device. For one thing, the concave tracks and the curved arcs of the wheel rests assume a standard distance between opposing wheels of a wheelchair. In fact, such a distance is not standardized. This is particular so because wheelchairs are of different sizes to accommodate persons ranging from small children to large adults. In this respect, it would be desirable if a wheelchair tilting device were provided which is readily adaptable to a wide variety of sizes of wheelchairs. In addition, with the device disclosed in the patent, the headrest is located at a fixed distance from the back of a wheelchair. In this respect, it would be desirable if a wheelchair tilting device were provided which included an adjustable headrest.

U.S. Pat. No. 4,726,730 discloses an electrically powered wheelchair tilting device which does not include a headrest and which does include a jacking mechanism for raising and lowering the person in the tilted wheelchair. The presence of a jacking mechanism is an unnecessary complexity for a wheelchair tilting mechanism which is designed simply to relieve back aches and circulation problems. In this respect, it would be desirable if a wheelchair tilting device were provided which does not include a jacking mechanism for raising and lowering the tilted wheelchair.

U.S. Pat. No. 4,834,411 discloses a wheelchair tilting device that is hand operated. The wheelchair is first secured to the tilt frame with clamps, and the wheelchair is tilted so that the person seated in the wheelchair has one's head positioned over a sink for shampooing. This wheelchair tilting device does not have a headrest as this would get in the way of the shampooing process. Moreover, when the wheelchair is tilted back on its large rear wheel, the small front wheels of the wheelchair are left unsecured in the air. In this respect, it would be desirable if a wheelchair tilting device were provided which included a device for securing the front wheels when the wheelchair is tilted backwards.

Still other features would be desirable in a wheelchair tilting apparatus. For example, it would be deskable if the wheelchair tilting apparatus had its own arm rests. It would also be desirable if the arm rests could be tilted somewhat out of the way when the tilting process takes place. It would also be desirable if the wheelchair tilting apparatus had an adjustable back stop for positioning the back of the wheelchair in the apparatus. It would also be desirable if the wheelchair tilting apparatus had a device for fixing the small front wheels of the wheelchair in a predetermined position.

Thus, while the foregoing body of prior art indicates it to be well known to use wheelchair tilting devices, the prior art described above does not teach or suggest a wheelchair tilting apparatus which has the following combination of desirable features: (1) alleviates back fatigue and circulation problems without having the person get out of the wheelchair; (2) includes an electrically operated tilt mechanism; (3) does not require a complex array of linkage bars; (4) is readily adaptable to a wide variety of sizes of wheelchairs; (5) includes an adjustable headrest; (6) does not include a jacking mechanism for raising and lowering the tilted wheelchair; (7) includes a device for securing the front wheels when the wheelchair is tilted backwards; (8) has its own arm rests; (9) has arm rests which can be tilted somewhat out of the way when the firing process takes place; (10) has an adjustable back stop for positioning the back of the wheelchair in the apparatus; and (11) has a device for fixing the small front wheels of the wheelchair in a predetermined position. The foregoing desired characteristics are provided by the unique wheelchair tilting apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved wheelchair tilting apparatus which includes a base assembly and a wheelchair receiving assembly supported by the base assembly. The wheelchair receiving assembly includes a first platform portion and a first frame assembly supporting the first platform portion. The wheelchair receiving assembly also includes a second platform portion and a second frame assembly supporting the second platform portion. The first frame assembly and the second frame assembly are connected to each other and oriented with respect to each other at a predetermined obtuse angle, such that the first platform portion and the second platform portion are oriented with respect to each other at the predetermined obtuse angle. A tilt assembly is supported by the base assembly and is provided for tilting the wheelchair receiving assembly after a wheelchair is received in the wheelchair receiving assembly. The tilt assembly includes an electric motor, a drive gear driven by the electric motor, and a driven gear that is connected to the wheelchair receiving assembly, such that the tilt assembly controls a tilt angle of the wheelchair receiving assembly and the wheelchair supported thereon.

Wheel assemblies are connected to bottom portions of the base assembly. A wheel-stop assembly is connected to the first platform portion for preventing rolling of the wheelchair when the wheelchair is resting on the first platform portion. The wheel-stop assembly includes a portion which prevents front wheels of the wheelchair from rolling. The wheel-stop assembly includes a planar stop plate and a swingable member supporting the planar stop plate. The swingable member includes a first lever arm portion which supports the planar stop plate and includes a second lever arm portion distal to the first lever arm portion. A pivot assembly is supported by the first platform portion below the first platform portion. The pivot assembly supports the swingable member and positioned between the first lever arm portion and the second lever arm portion. The pivot assembly serves as a fulcrum between the first lever arm portion and the second lever arm portion. A spring member is supported by the pivot assembly. The spring member contacts the second lever arm portion and urges the second lever arm portion downward such that the first lever arm portion pivots around the pivot assembly and raises the planar stop plate above the first platform portion, whereby the raised planar stop plate prevents front wheels of the wheelchair from rolling. A ramp member is attached to the first platform portion for facilitating rolling of a wheelchair onto the first platform portion.

A first side frame assembly is supported by a portion of the first frame assembly and by a portion of the second frame assembly. A second side frame assembly is also supported by a portion of the first frame assembly and by a portion of the second frame assembly. A wheelchair backstop assembly is connected between the first side frame assembly and the second side frame assembly. The wheelchair backstop assembly is provided for receiving a back portion of a wheelchair when the wheelchair is in a tilted orientation. The wheelchair backstop assembly is horizontally adjustable on the respective portions of the first frame assembly and the second frame assembly which support the wheelchair backstop assembly. The wheelchair backstop assembly includes adjustment slots for adjusting the wheelchair backstop assembly with respect to the first frame assembly and the second frame assembly.

A headrest assembly is connected between the first side frame assembly and the second side frame assembly. The headrest assembly is provided for receiving a head of a person sitting in a wheelchair when the wheelchair is in a tilted orientation. The headrest assembly is vertically adjustable on the respective portions of the first frame assembly and the second frame assembly which support the headrest assembly. The headrest assembly includes adjustment slots for adjusting the headrest assembly with respect to the first frame assembly and the second frame assembly.

A respective arm rest assembly is connected to each of the respective first side frame assembly and the respective second side frame assembly. Each respective arm rest assembly includes a pivot pin which is connected to a respective side frame assembly and also includes a pivotable arm rest member which is pivotally connected to the pivot pin.

The pivotable arm rest member is pivotally connected to the pivot pin near an edge portion of the pivotable arm rest member, such that the pivotable arm rest member is capable of two rest positions. A first rest position is provided when a main body portion of the pivotable arm rest member is oriented vertically for permitting a wheelchair to be rolled on the wheelchair receiving assembly. A second rest position is provided when the main body portion of the pivotable arm rest member is oriented horizontally for permitting a person sitting in a wheelchair to rest one's arms on the respective main body portions.

The above brief description sets forth rather broadly the more important features of the present invention in order that the detailed description thereof that follows may be better understood, and in order that the present contributions to the art may be better appreciated. There are, of course, additional features of the invention that will be descried hereinafter and which will be for the subject matter of the claims appended hereto.

In this respect, before explaining the most preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved wheelchair tilting apparatus which has all of the advantages of the prior art and none of the disadvantages.

It is another object of the present invention to provide a new and improved wheelchair tilting apparatus which may be easily and efficiently manufactured and marketed.

It is a further object of the present invention to provide a new and improved wheelchair tilting apparatus which is of durable and reliable construction.

An even further object of the present invention is to provide a new and improved wheelchair tilting apparatus which is susceptible of a low cost of manufacture with regard to both materials and labor, and which accordingly is then susceptible of low prices of sale to the consuming public, thereby making such wheelchair tilting apparatus available to the buying public.

Still yet a further object of the present invention is to provide a new and improved wheelchair tilting apparatus which alleviates back fatigue and circulation problems without having the person get out of the wheelchair.

Still another object of the present invention is to provide a new and improved wheelchair tilting apparatus that includes an electrically operated tilt mechanism.

Yet another object of the present invention is to provide a new and improved wheelchair tilting apparatus which does not require a complex array of linkage bars.

Even another object of the present invention is to provide a new and improved wheelchair tilting apparatus that is readily adaptable to a wide variety of sizes of wheelchairs.

Still a further object of the present invention is to provide a new and improved wheelchair tilting apparatus which includes an adjustable headrest.

Yet another object of the present invention is to provide a new and improved wheelchair tilting apparatus that does not include a jacking mechanism for raising and lowering the tilted wheelchair.

Still another object of the present invention is to provide a new and improved wheelchair tilting apparatus which includes a device for securing the front wheels when the wheelchair is tilted backwards.

Yet another object of the present invention is to provide a new and improved wheelchair tilting apparatus that has its own arm rests.

Still a further object of the present invention is to provide a new and improved wheelchair tilting apparatus that has arm rests which can be tilted somewhat out of the way when the tilting process takes place.

Yet another object of the present invention is to provide a new and improved wheelchair tilting apparatus which has an adjustable back stop for positioning the back of the wheelchair in the apparatus.

Still a further object of the present invention is to provide a new and improved wheelchair tilting apparatus that has a device for fixing the small front wheels of the wheelchair in a predetermined position.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated at least one preferred embodiment of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved wheelchair tilting apparatus embodying the principles and concepts of the present invention will be described.

Figure 1:
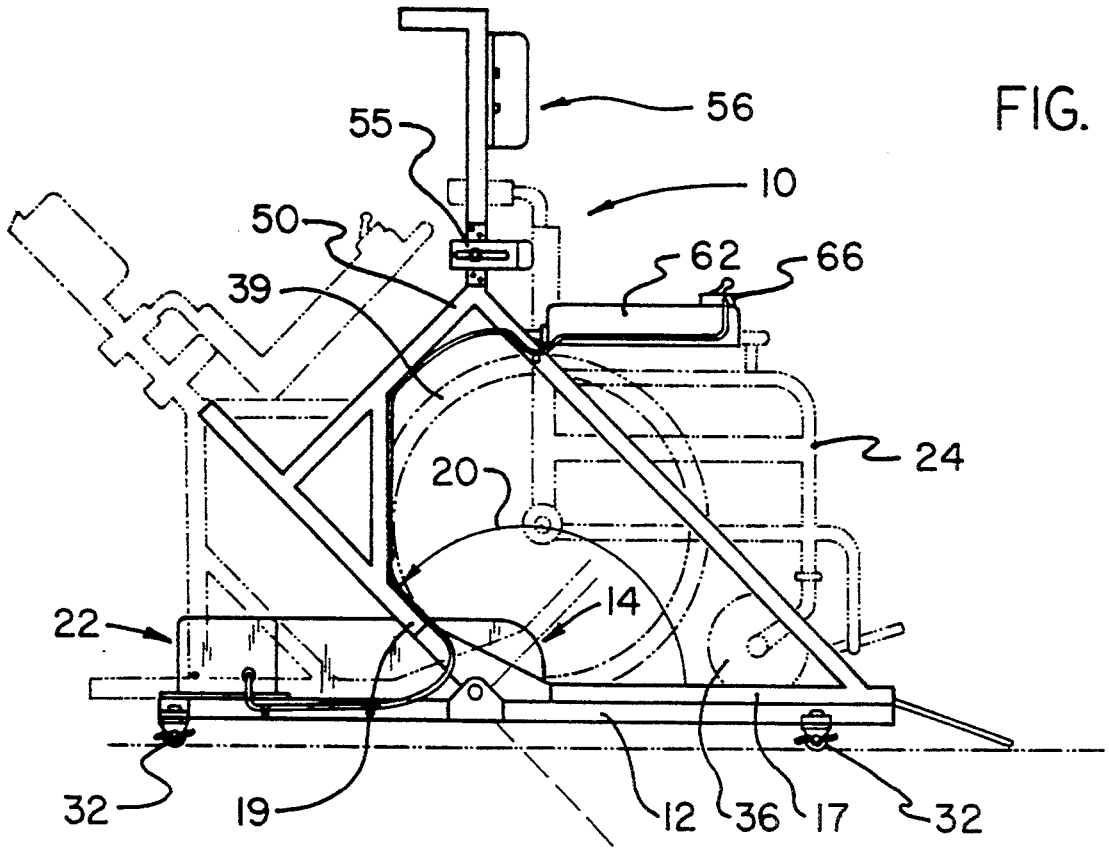
FIG. 1 is a side view showing a first preferred embodiment of the wheelchair tilting apparatus of the invention with the wheelchair shown in phantom in both an upright and a tilted-backward position.
Figure 2:
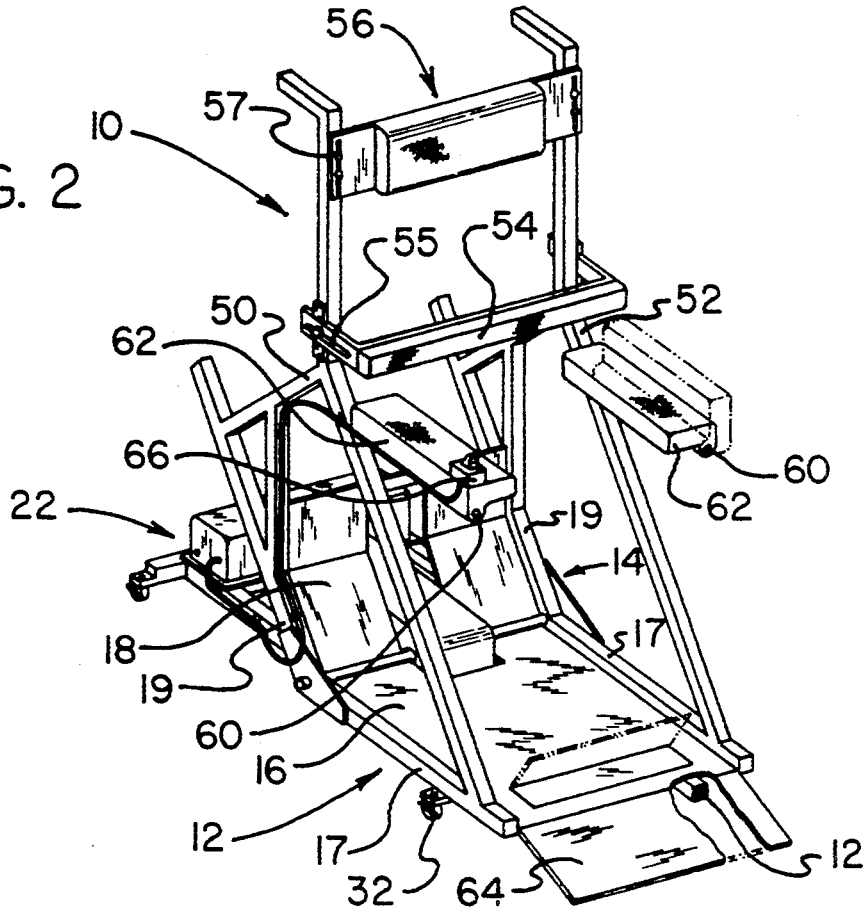
FIG. 2 is a perspective view of the embodiment of the wheelchair tilting apparatus shown in FIG. 1 without a wheelchair being present on the apparatus.
Figure 3:
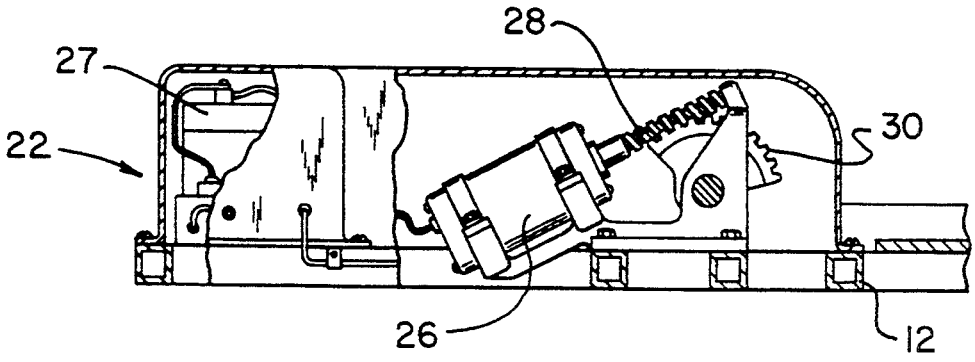
FIG. 3 is an enlarged, partially broken away view of an electric motor drive for tilting the embodiment of the wheelchair tilting apparatus of the invention shown in FIGS. 1 and 2.
Figure 4:
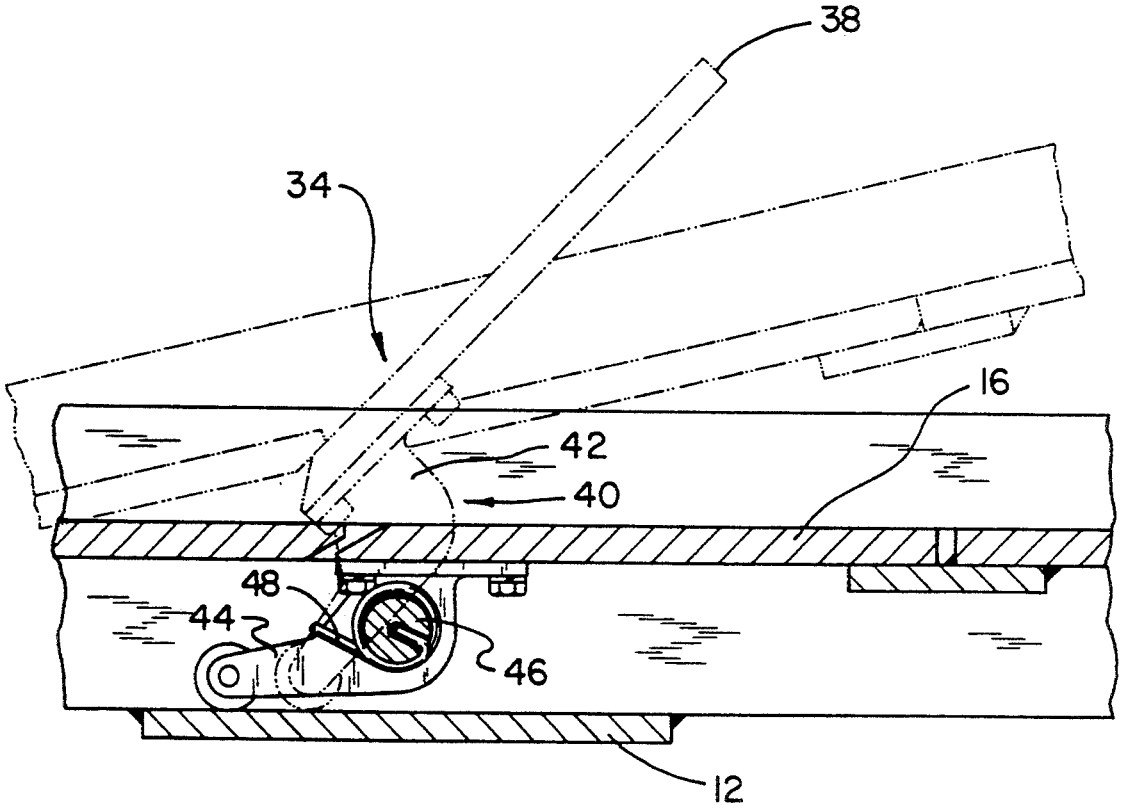
FIG. 4 is an enlarged cross-sectional view of a device for securing the small front wheels of a wheelchair.

Turning to FIGS. 1–4, there is shown an exemplary embodiment of the wheelchair tilting apparatus of the invention generally designated by reference numeral 10. In its preferred form, wheelchair tilting apparatus 10 includes a base assembly 12 and a wheelchair receiving assembly 14 supported by the base assembly 12. The wheelchair receiving assembly 14 includes a first platform portion 16 and a first frame assembly 17 supporting the first platform portion 16. The wheelchair receiving assembly 14 also includes a second platform portion 18 and a second frame assembly 19 supporting the second platform portion 18. The first frame assembly 17 and the second frame assembly 19 are connected to each other and oriented with respect to each other at a predetermined obtuse angle 20, such that the first platform portion 16 and the second platform portion 18 are oriented with respect to each other at the predetermined obtuse angle 20. A tilt assembly 22 is supported by the base assembly 12 and is provided for tilting the wheelchair receiving assembly 14 after a wheelchair 24 is received in the wheelchair receiving assembly 14. The tilt assembly 22 includes an electric motor 26, a drive gear 28 driven by the electric motor 26, and a driven gear 30 that is connected to the wheelchair receiving assembly 14, such that the tilt assembly 22 controls a tilt angle of the wheelchair receiving assembly 14 and the wheelchair 24 supported thereon. The tilt assembly 22 includes a control assembly 66 positioned on an arm rest assembly 58. The source of electrical power for the electric motor 26 can be either a battery 27 or an AC power source. The electric motor 26 can be a DC motor that is powered by either a battery or an AC power source through an AC to DC converter.

Wheel assemblies 32 are connected to bottom portions of the base assembly 12. The wheel assemblies 32 can be in the form of wheels on casters. wheel-stop assembly 34 is connected to the first platform portion 16 for preventing rolling of the wheelchair 24 when the wheelchair 24 is resting on the first platform portion 16. The wheel-stop assembly 34 includes a portion which prevents front wheels 36 of the wheelchair 24 from rolling. The wheel-stop assembly 34 includes a planar stop plate 38 and a swingable member 40 supporting the planar stop plate 38. The swingable member 40 includes a first lever arm portion 42 which supports the planar stop plate 38 and includes a second lever arm portion 44 distal to the first lever arm portion 42. A pivot assembly 46 is supported by the first platform portion 16 below the first platform portion 16. The pivot assembly 46 supports the swingable member 40 and positioned between the first lever arm portion 42 and the second lever arm portion 44. The pivot assembly 46 serves as a fulcrum between the first lever arm portion 42 and the second lever arm portion 44. A spring member 48 is supported by the pivot assembly 46. The spring member 48 contacts the second lever arm portion 44 and urges the second lever arm portion 44 downward such that the first lever arm portion 42 pivots around the pivot assembly 46 and raises the planar stop plate 38 above the first platform portion 16, whereby the raised planar stop plate 38 prevents front wheels 36 of the wheelchair 24 from rolling. A ramp member 64 is attached to the first platform portion 16 for facilitating rolling of a wheelchair 24 onto the first platform portion 16.

A first side frame assembly 50 is supported by a portion of the first frame assembly 17 and by a portion of the second frame assembly 19. A second side frame assembly 52 is also supported by a portion of the first frame assembly 17 and by a portion of the second frame assembly 19. A wheelchair backstop assembly 54 is connected between the first side frame assembly 50 and the second side frame assembly 52. The wheelchair backstop assembly 54 is provided for receiving a back portion of a wheelchair 24 when the wheelchair 24 is in a tilted orientation. The wheelchair backstop assembly 54 is horizontally adjustable on the respective portions of the first frame assembly 17 and the second frame assembly 19 which support the wheelchair backstop assembly 54. The wheelchair backstop assembly 54 includes adjustment slots 55 for adjusting the wheelchair backstop assembly 54 with respect to the first frame assembly 17 and the second frame assembly 19.

A headrest assembly 56 is connected between the first side frame assembly 50 and the second side frame assembly 52. The headrest assembly 56 is provided for receiving a head of a person sitting in a wheelchair 24 when the wheelchair 24 is in a tilted orientation. The headrest assembly 56 is vertically adjustable on the respective portions of the first frame assembly 17 and the second frame assembly 19 which support the headrest assembly 56. The headrest assembly 56 includes adjustment slots 57 for adjusting the headrest assembly 56 with respect to the first frame assembly 17 and the second frame assembly 19.

A respective arm rest assembly 58 is connected to each of the respective first side frame assembly 50 and the respective second side frame assembly 52. Each respective arm rest assembly 58 includes a pivot pin 60 which is connected to a respective side frame assembly and also includes a pivotable arm rest member 62 which is pivotally connected to the pivot pin 60.

The pivotable arm rest member 62 is pivotally connected to the pivot pin 60 near an edge portion of the pivotable arm rest member 62, such that the pivotable arm rest member 62 is capable of two rest positions. A first rest position is provided when a main body portion of the pivotable arm rest member 62 is oriented vertically for permitting a wheelchair 24 to be rolled on the wheelchair receiving assembly 14. A second rest position is provided when the main body portion of the pivotable arm rest member 62 is oriented horizontally for permitting a person sitting in a wheelchair 24 to rest one's arms on the respective main body portions.

In use, the pivotable arm rest members 62 are moved upward on pivot pin 60. The ramp member 64 is in position on the first platform portion 16. The wheelchair 24 is rolled up onto the first platform portion 16 with the large wheels 39 resting up against the second platform portion 18. The rear of the wheelchair 24 butts up against the wheelchair backstop assembly 54 which has been adjusted for contact with the rear of the wheelchair 24. The person in the wheelchair 24 controls the tilt assembly 22 by way of the control assembly 66. As the wheelchair receiving assembly 14 tilts upward, the planar stop plate 38 of the wheel-stop assembly 34 is urged upward by the spring member 48 around the pivot assembly 46, and the planar stop plate 38 presses up against the front wheels 36 of the wheelchair 24, thereby helping to secure the wheelchair 24 into the wheelchair receiving assembly 14. When the wheelchair 24 is in the desired angle of tilt, the pivotable arm rest members 62 are repositioned on the pivot pins 60 so that the pivotable arm rest members 62 are oriented coplanar with the first platform portion 16. When the tilt assembly 22 is returned to the initial position, the second lever arm portion 44 of the swingable member 40 comes into contact with the base assembly 12, and the planar stop plate 38 is moved by lever action to a horizontal orientation coplanar with the first platform portion 16. The wheelchair 24 is rolled off of the first platform portion 16 and off of the ramp member 64. The pivotable arm rest members 62 are oriented vertically around the respective pivot pins 60.

The first frame assembly 17, the second frame assembly 19, the first side frame assembly 50, and the second side frame assembly 52 can be made for square steel tubing that is bent and welded. The first platform portion 16 and the second platform portion 18 can be made from metal plates. If desired, side panels can be attached to the respective first side frame assembly 50 and the respective second side frame assembly 52 for decorative purposes. Although wide variations are possible, the basic unit can be approximately 30 inches by 48 inches in size. The entire apparatus could be shipped in a box and assembled by a dealer on location.

The components of the wheelchair tilting apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved wheelchair tilting apparatus that is low in cost, relatively simple in design and operation, and which may advantageously be used to alleviate back fatigue and circulation problems without having the person get out of the wheelchair. With the invention, a wheelchair tilting apparatus is provided which includes an electrically operated tilt mechanism.

With the invention, a wheelchair tilting apparatus is provided which does not require a complex array of linkage bars. With the invention, a wheelchair tilting apparatus is provided which is readily adaptable to a wide variety of sizes of wheelchairs. With the invention, a wheelchair tilting apparatus is provided which includes an adjustable headrest. With the invention, a wheelchair tilting apparatus is provided which does not include a jacking mechanism for raising and lowering the tilted wheelchair. With the invention, a wheelchair tilting apparatus is provided which includes a device for securing the front wheels when the wheelchair is tilted backwards. With the invention, a wheelchair tilting apparatus is provided which has its own arm rests. With the invention, a wheelchair tilting apparatus is provided which has arm rests which can be tilted somewhat out of the way when the tilting process takes place. With the invention, a wheelchair tilting apparatus is provided which has an adjustable back stop for positioning the back of the wheelchair in the apparatus. With the invention, a wheelchair tilting apparatus is provided which has a device for fixing the small front wheels of the wheelchair in a predetermined position.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by LETTERS PATENT of the United States is as follows:

1. A new and improved wheelchair tilting apparatus, comprising:

a base assembly, a wheelchair receiving assembly supported by said base assembly, said wheelchair receiving assembly including a first platform portion and a first frame assembly supporting said first platform portion, said wheelchair receiving assembly including a second platform portion and a second frame assembly supporting said second platform portion, said first frame assembly and said second frame assembly connected to each other and oriented with respect to each other at a predetermined obtuse angle, such that said first platform portion and said second platform portion are oriented with respect to each other at said predetermined obtuse angle, a tilt assembly, supported by said base assembly, for tilting said wheelchair receiving assembly when a wheelchair is received in said wheelchair receiving assembly, said tilt assembly including an electric motor, a drive gear driven by said electric motor, and a driven gear connected to said wheelchair receiving assembly, such that said tilt assembly controls a tilt angle of said wheelchair receiving assembly and the wheelchair supported thereon, wheel assemblies connected to bottom portions of said base assembly, a wheel-stop assembly connected to said first platform portion for stopping rolling of the wheelchair when the wheelchair is resting on said first platform portion, said wheel-stop assembly including a portion which prevents front wheels of the wheelchair from rolling, a ramp member attachable to said first platform portion for facilitating rolling of a wheelchair onto said first platform portion, a first side frame assembly supported by a portion of said first frame assembly and by a portion of said second frame assembly, a second side frame assembly supported by a portion of said first frame assembly and by a portion of said second frame assembly, a wheelchair backstop assembly connected between said first side frame assembly and said second side frame assembly, said wheelchair backstop assembly for receiving a back portion of a wheelchair when the wheelchair is in a tilted orientation, wherein said wheelchair backstop assembly is horizontally adjustable on said respective portions of said first frame assembly and said second frame assembly which support said wheelchair backstop assembly, a headrest assembly connected between said first side frame assembly and said second side frame assembly, said headrest assembly for receiving a head of a person sitting in a wheelchair when the wheelchair is in a tilted orientation, an arm rest assembly connected to each of said respective first side frame assembly and said respective second side frame assembly, wherein each arm rest assembly includes a pivot pin connected to a respective side frame assembly, and a pivotable arm rest member pivotally connected to said pivot pin, wherein said pivotable arm rest member is pivotally connected to said pivot pin near a longitudinal edge portion of said pivotable arm rest member, such that said pivotable arm rest member is capable of two rest positions, a first rest position wherein a main body portion of said pivotable arm rest member is oriented vertically for permitting a wheelchair to be rolled on said wheelchair receiving assembly, and a second rest position wherein said main body portion of said pivotable arm rest member is oriented horizontally for permitting a person sitting in a wheelchair to rest one's arms on said respective main body portions.

2. The apparatus described in claim 1 wherein said wheel-stop assembly includes:

a planar stop plate, a swingable member supporting said planar stop plate, said swingable member including a first lever arm portion which supports said planar stop plate and including a second lever arm portion distal to said first lever arm portion, a pivot assembly, supported by said first platform portion below said first platform portion, said pivot assembly supporting said swingable member and positioned between said first lever arm portion and said second lever arm portion, said pivot assembly serving as a fulcrum between said first lever arm portion and said second lever arm portion, and a spring member supported by said pivot assembly, said spring member contacting said second lever arm portion and urging said second lever arm portion downward such that said first lever arm portion pivots around said pivot assembly and raises said planar stop plate above said first platform portion, whereby said raised planar stop plate prevents front wheels of the wheelchair from rolling.

3. The apparatus described in claim 1 wherein said wheelchair backstop assembly includes adjustment slots for adjusting said wheelchair backstop assembly with respect to said first frame assembly and said second frame assembly.

4. The apparatus described in claim 1 wherein said headrest assembly is vertically adjustable on said respective portions of said first frame assembly and said second frame assembly which support said headrest assembly.

5. The apparatus described in claim 4 wherein said headrest assembly includes adjustment slots for adjusting said headrest assembly with respect to said first frame assembly and said second frame assembly.

6. The apparatus described in claim 1 wherein said tilt assembly includes a control assembly positioned on an arm rest assembly.

* * * * *